US006240818B1

(12) United States Patent
Baltschun

(10) Patent No.: US 6,240,818 B1
(45) Date of Patent: Jun. 5, 2001

(54) PRECISION BLANKING PRESS WITH KNIFE-EDGED RING AND COUNTER CYLINDER

(75) Inventor: Horst Baltschun, Rülzheim (DE)

(73) Assignee: Feintool International Holding AG (CH)

( * ) Notice: Subject to any disclaimer, the term of this patent is extended or adjusted under 35 U.S.C. 154(b) by 0 days.

(21) Appl. No.: 09/155,434

(22) PCT Filed: Mar. 27, 1997

(86) PCT No.: PCT/IB97/00312

§ 371 Date: Sep. 25, 1999

§ 102(e) Date: Sep. 25, 1999

(87) PCT Pub. No.: WO97/35675

PCT Pub. Date: Oct. 2, 1997

(30) Foreign Application Priority Data

Mar. 28, 1996 (DE) ..... 196 12 351

(51) Int. Cl.[7] ..... B27F 1/14

(52) U.S. Cl. ..... 83/137; 83/639.1; 83/684

(58) Field of Search ..... 83/124, 132, 137, 83/639.1, 679, 684, 686, 623, 621

(56) References Cited

U.S. PATENT DOCUMENTS

| | | | | |
|---|---|---|---|---|
| 2,547,118 | * | 4/1951 | Hart | 83/124 |
| 2,642,138 | * | 6/1953 | Macewka | 83/137 |
| 3,564,959 | * | 2/1971 | Harada | 83/124 |
| 3,570,343 | * | 3/1971 | Wolnosky | 83/124 |
| 3,611,854 | * | 10/1971 | Gilev | 83/132 |
| 3,771,396 | * | 11/1973 | Im | 83/623 |
| 4,043,236 | * | 8/1977 | De Jong | 83/137 |
| 4,611,483 | * | 9/1986 | Hadaway | 83/132 |
| 4,662,256 | * | 5/1987 | Hicks | 83/124 |
| 4,934,230 | * | 6/1990 | Wallis | 83/137 |
| 5,247,862 | * | 9/1993 | Haack | 83/124 |
| 5,692,423 | * | 12/1997 | Hachikawa et al. | 83/137 |
| 5,749,279 | * | 5/1998 | Gardner | 83/686 |

FOREIGN PATENT DOCUMENTS

| | | | | |
|---|---|---|---|---|
| 370618 | * | 7/1963 | (CH) | 83/137 |
| 1249805 | * | 9/1967 | (DE) | 83/320 |
| 12595 | * | 9/1967 | (JP) | 83/324 |

* cited by examiner

*Primary Examiner*—M. Rachuba
*Assistant Examiner*—Omar Flores-Sánchez
(74) *Attorney, Agent, or Firm*—Bachman & LaPointe, P.C.

(57) ABSTRACT

The press slide of a hydraulically or mechanically driven precision blanking press is non-positively connected with a crosshead by means of columns. The knife-edged ring cylinder is integrated in the crosshead and the supporting force of the knife-edged ring cylinder is taken up by the slide. During a cutting stroke, there is no relative movement between the knife-edged ring cylinder with piston and the slide. The counter cylinder is located in the lower crosshead of the stand. During a cutting stroke, there is no relative movement between the counter cylinder and the workpiece in the tool. The working force of the main drive is not reduced by the pressing force of the knife-edged ring and counter cylinder.

2 Claims, 19 Drawing Sheets

PRECISION BLANKING PRESS WITH KNIFE-EDGED RING AND COUNTER CYLINDER

FIELD OF USE OF THE INVENTION

The invention relates to a hydraulically or mechanically driven precision blanking press with knife-edged ring cylinder and counterstay cylinder.

In the precision blanking of workpieces, smooth section surfaces free of scores and of fragmentation can be produced and fractures, such as usually occur during normal blanking, are avoided. An essential feature of precision blanking is the imprinting of a knife-edged ring parallel to the cutting line on the blanking screen side, so as to avoid an afterflow of the material here; the knife-edged ring is imprinted by the knife-edged ring cylinder. During the precision blanking process, the workpiece is pressed against the upper die from below by means of a special sheet counterstay, referred to below as "counterstay".

PRIOR ART

In conventional precision blanking presses, the force of the knife-edged ring cylinder, which is arranged in the upper crosshead as a machine stand, counteracts the cutting force. The counterstay cylinder, which is integrated in the slide or in the working piston, presses the workpiece against the die upper part; the counterstay supporting force counteracts the cutting force. The counterforce of the knife-edged ring cylinder amounts to 50% and that of the counterstay to 25% of the working force. These counterforces are converted into heat during the working stroke by virtue of the positive displacement principle and additionally reduce the cutting efficiency. In a conventional precision blanking press with a drive power of, for example, 100 kW, a cooling capacity of about 80 kW is installed, and the cutting force of, for example, 4000 kN may be reduced by 3000 kN.

OBJECT OF THE INVENTION

In light of the precision blanking presses known hitherto, with the unfavorable relation between the overall energy consumption and the actually usable cutting capacity, the problem on which the invention is based is to reduce the energy losses sharply on a precision blanking press. At the same time, the imprinting of the knife-edged ring and the bracing of the workpiece relative to the upper die must be ensured during the cutting operation of the precision blanking press.

ESSENCE OF THE INVENTION

According to the invention, the knife-edged ring cylinder is integrated in a crossmember above the upper crosshead and is connected fixedly to the slide, so that said cylinder moves upward synchronously with the slide. The counterstay cylinder is arranged between the slide and the lower crosshead of the stand. The piston of the knife-edged ring cylinder is held in its lower position by means of a pressure medium actuated supporting cylinder and thereby remains constantly in contact with the thrust bolts of the upper die. Due to the fastening of the supporting cylinder piston on the stand and integration in the knife-edged ring cylinder piston, the latter can move away upward during the working stroke in the event of pressure relief. At the end of the working stroke, the pressure medium actuated supporting cylinder pushes the knife-edged ring cylinder piston into its lower basic position and simultaneously strips off the knife-edged ring blanking screen.

The piston of the counterstay cylinder is held in its upper position by means of a pressure medium actuated supporting cylinder, with the result that said piston remains constantly in contact with the thrust bolts of the lower die. By the fastening of the supporting cylinder piston to the slide and integration in the counterstay cylinder piston, the latter can move away downward during the working stroke in the event of pressure relief. At the end of the working stroke, the pressure medium actuated supporting cylinder pushes the counterstay piston into its upper basic position and simultaneously thrusts the precision blanking part into the die space.

By virtue of the above-mentioned arrangement, the working force of the main drive can be utilized fully in order to cut out the precision blanking part. A precision blanking press, the energy losses of which are sharply reduced, is therefore now available. This is achieved, in particular, by the arrangement of the knife-edged ring cylinder and counterstay cylinder which, during the working stroke of the slide, clamp the blanking screen and the precision blanking part respectively, without a stroke being executed. No relative movement occurs between the knife-edged ring cylinder and the slide during the working stroke; the knife-edged ring cylinder supporting forces are absorbed by the slide. The working force of the main drive is not reduced by the knife-edged cylinder pressing force. At the same time, there is no relative movement between the counterstay cylinder and the stand during the working stroke; the counterstay cylinder supporting forces are absorbed by the stand. The working force of the main drive is not reduced by the counterstay cylinder pressing force.

BRIEF DESCRIPTION OF THE ACCOMPANYING DRAWING

Figure 3:
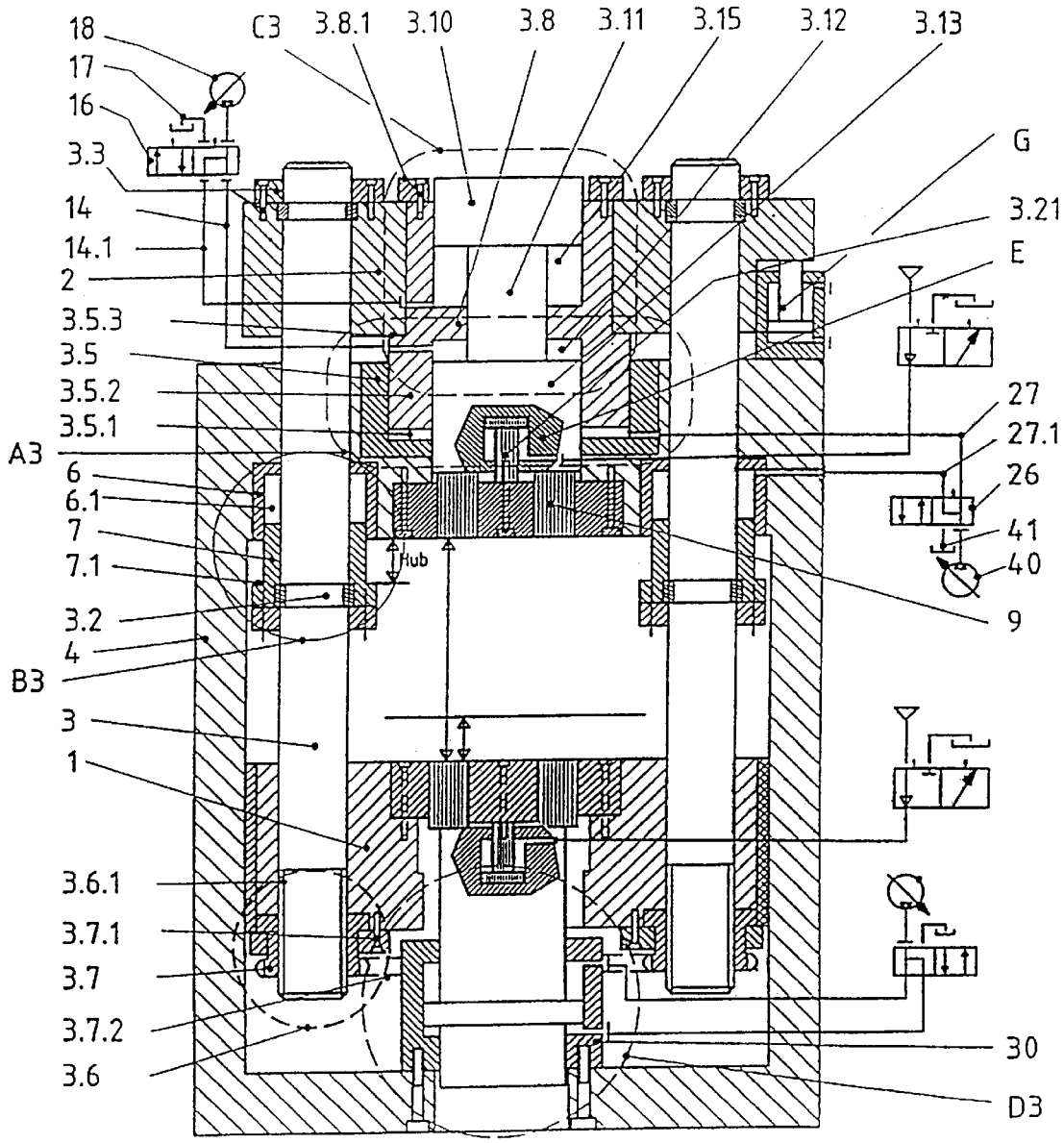
FIG. 3 shows an embodiment according to FIGS. 1 and 2, but with installation space adjustment, the working cylinder being arranged in the upper crosshead of the stand, and the knife-edged ring cylinder being integrated in the piston of the working cylinder.
Figure 10:
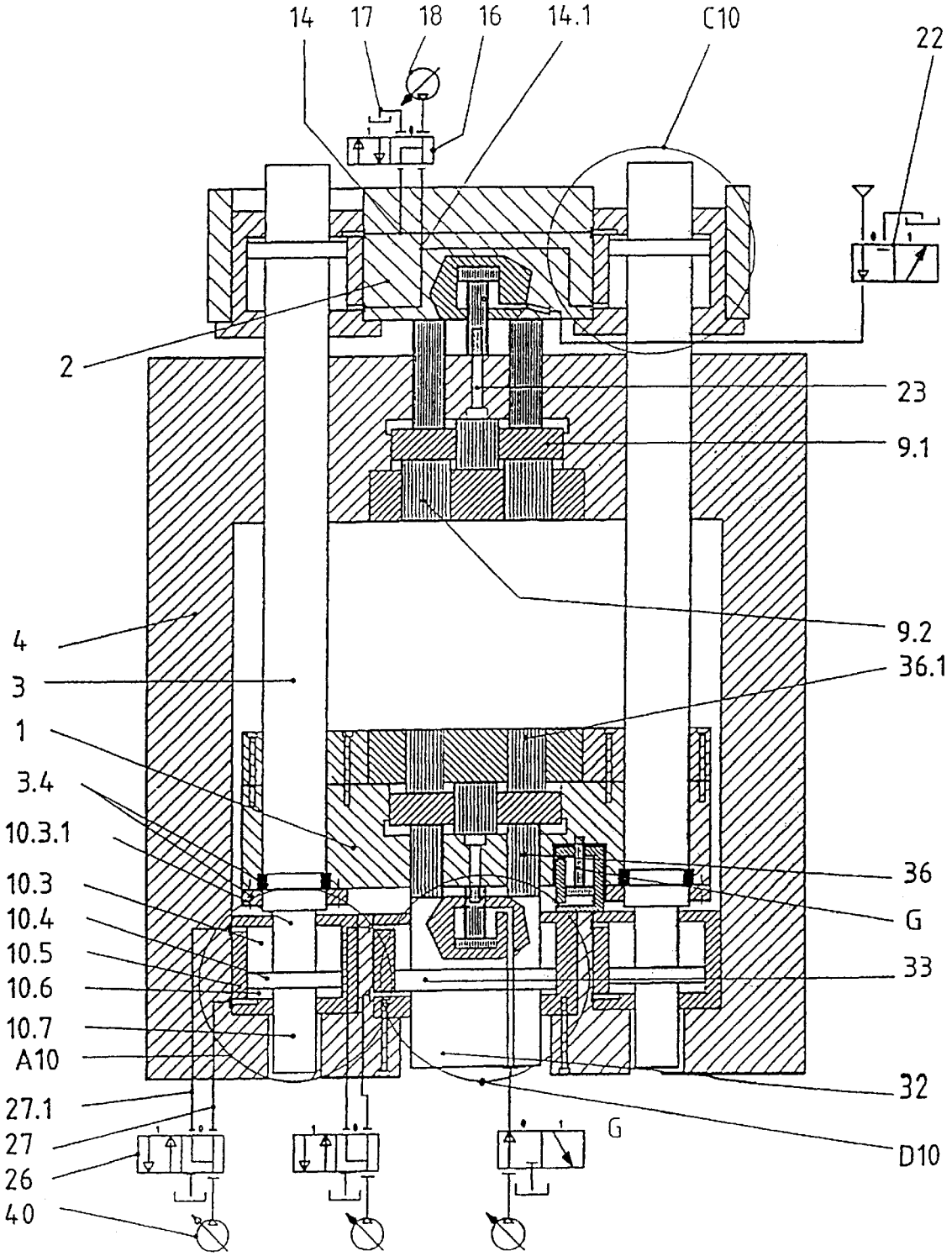
FIG. 10 shows an embodiment according to FIG. 9, the knife-edged ring cylinders being integrated on the columns in the crossmember and the double-acting working cylinders being integrated on the columns in the stand.
Figure 11:
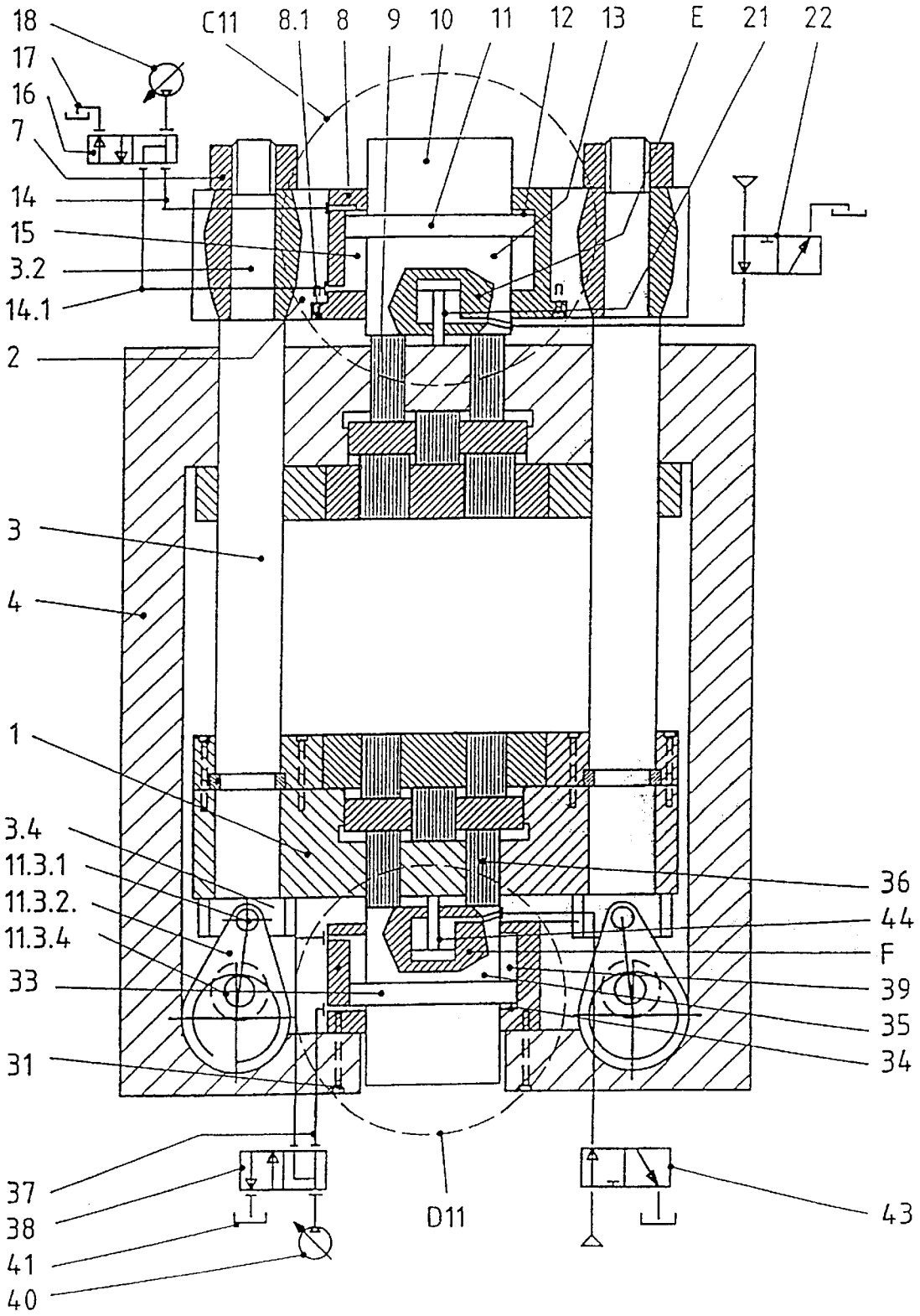
FIG. 11 shows an embodiment according to FIG. 1, the infeed stroke and the working stroke being generated by means of a mechanical toggle or eccentric drive.
Figure 13:
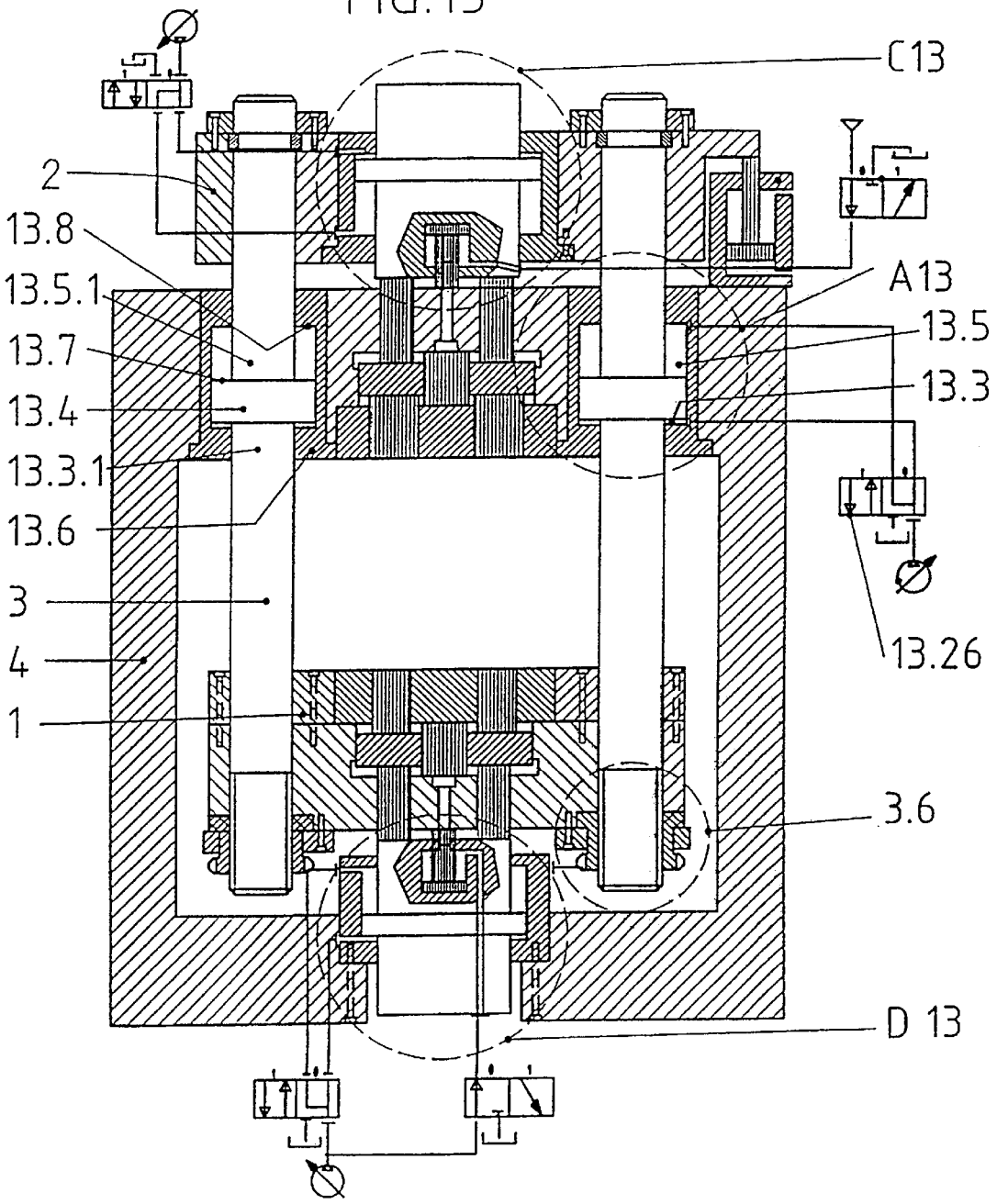
FIG. 13 shows an embodiment according to FIG. 12, but with a double-acting prestressed working cylinder.
Figure 14:
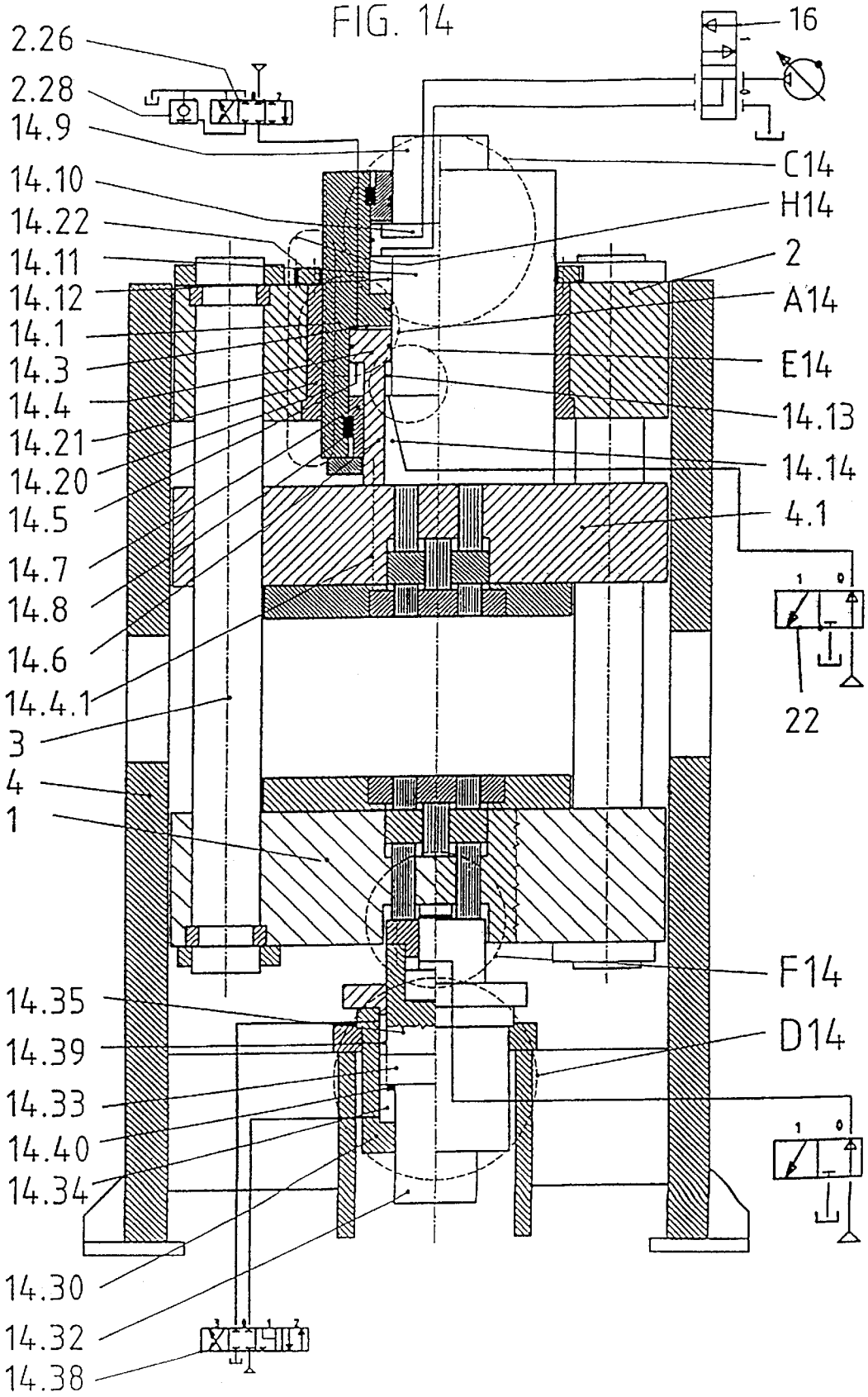
Figure 15:
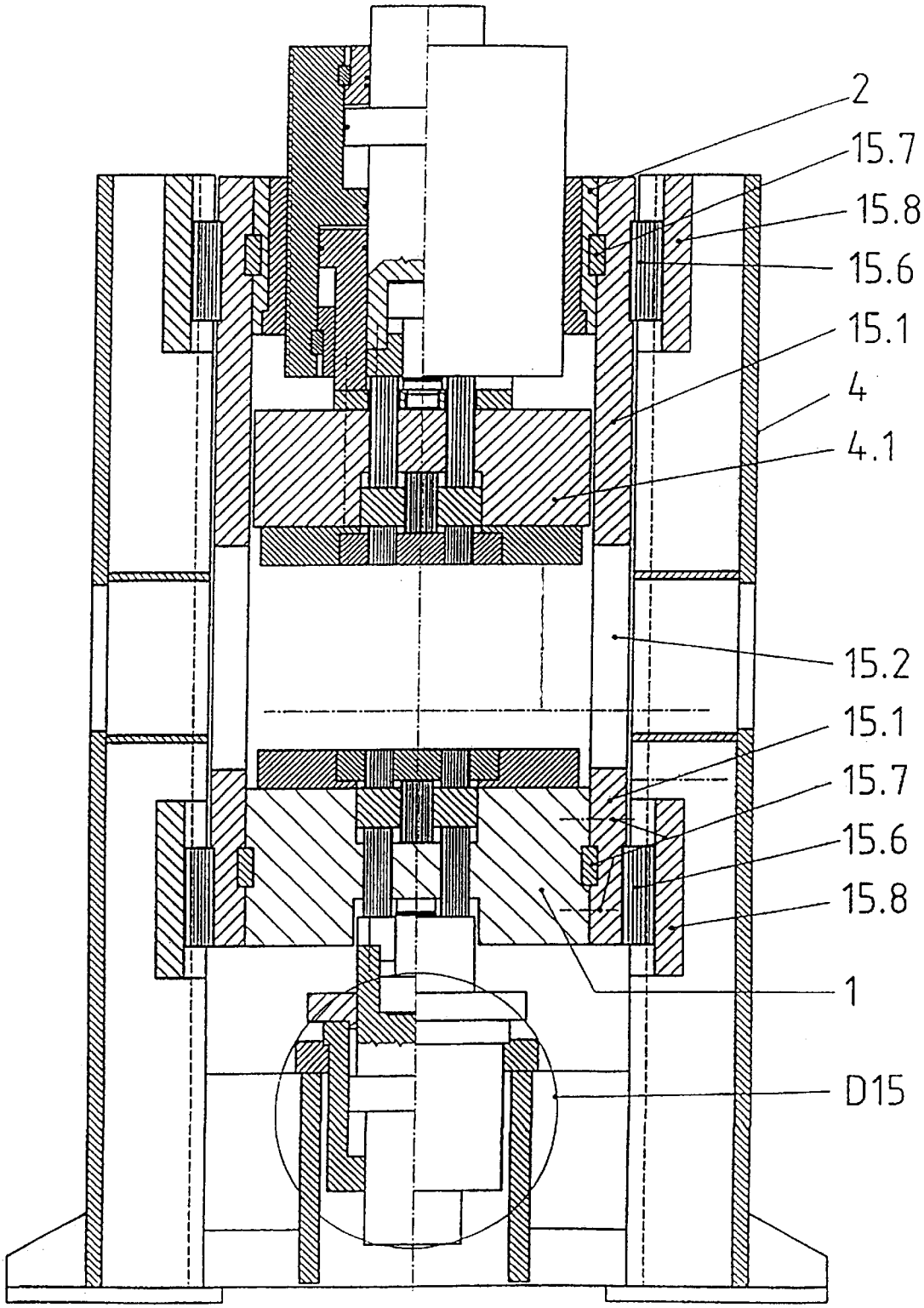
Figure 16:
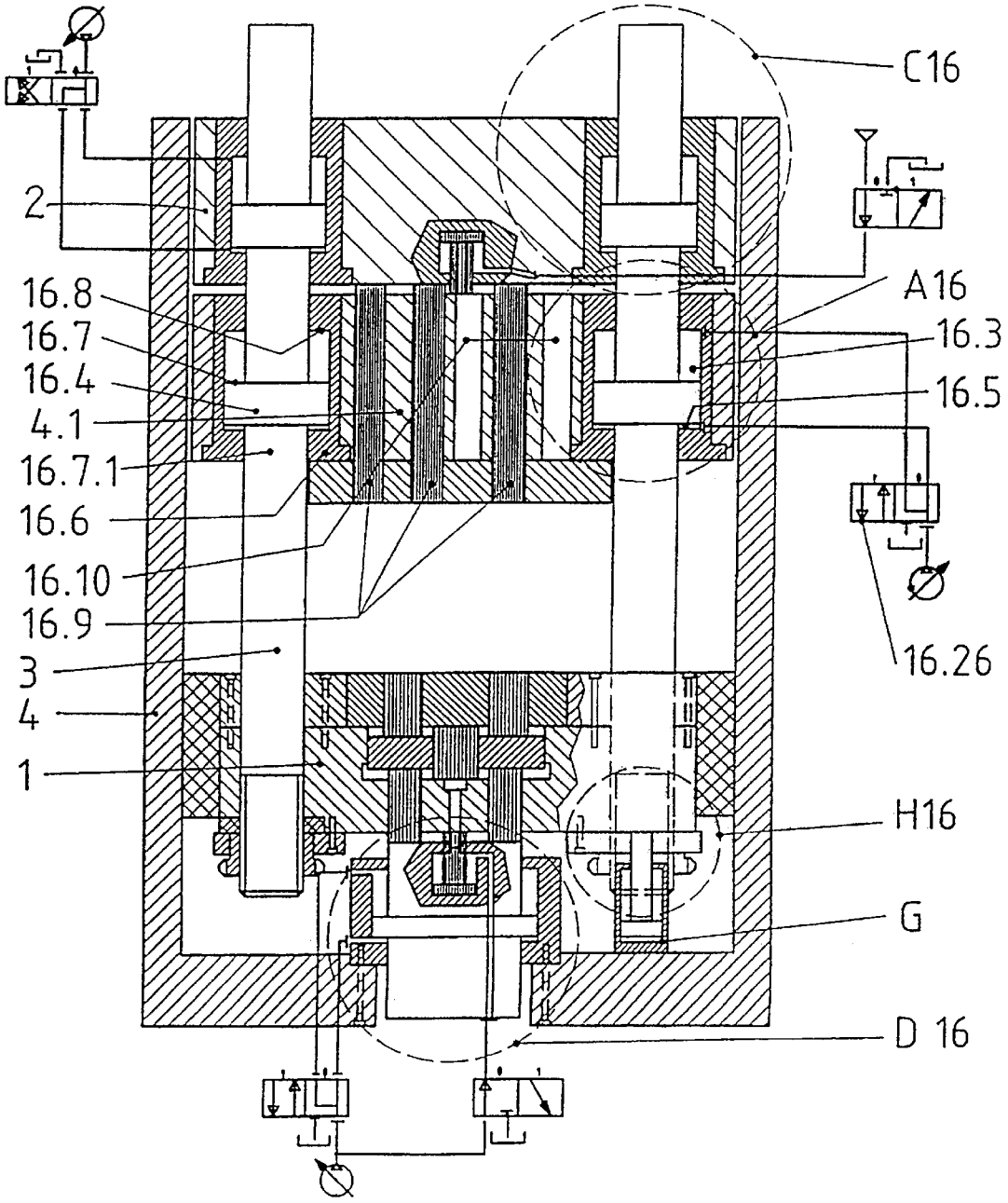
Figure 17:
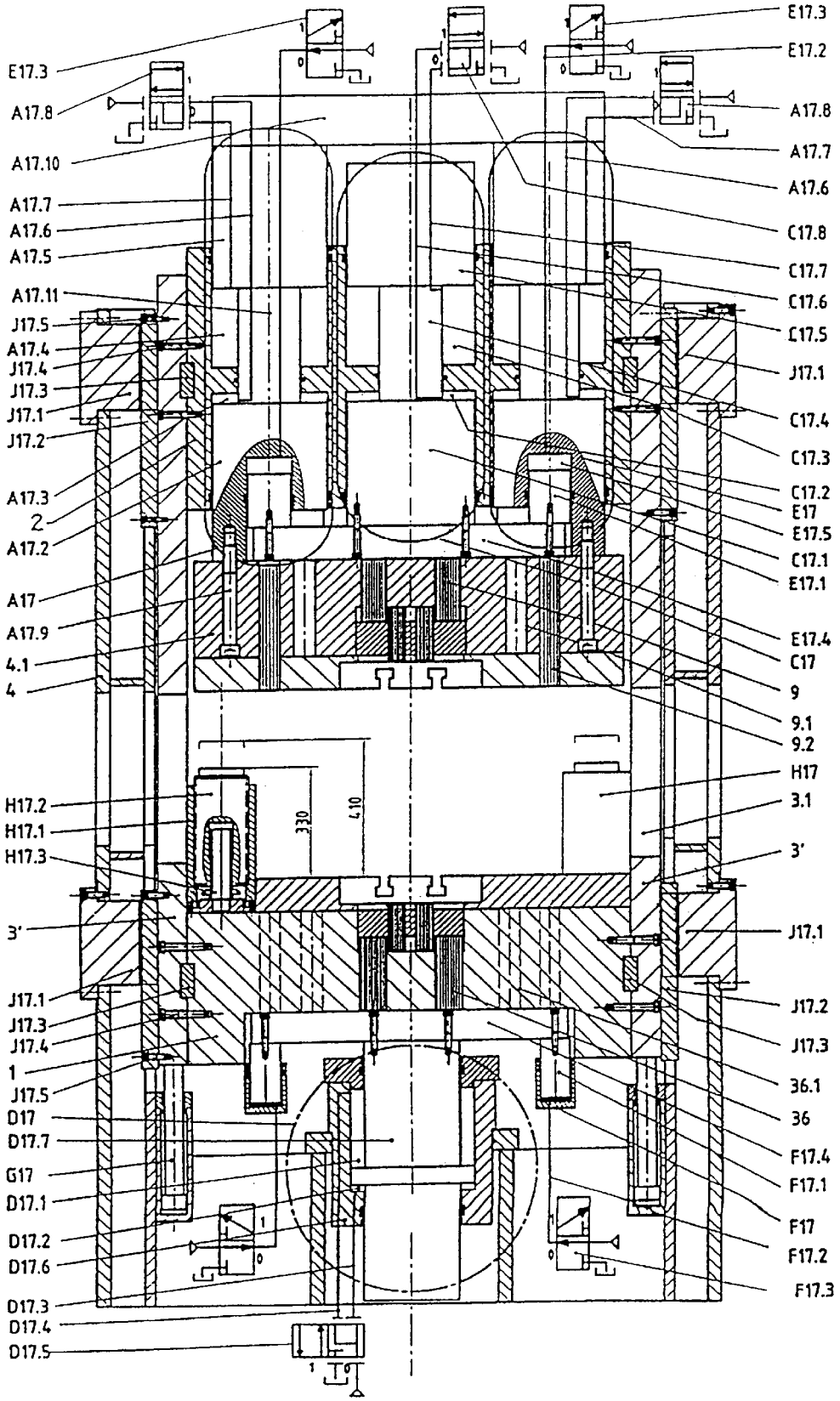
Figure 18:
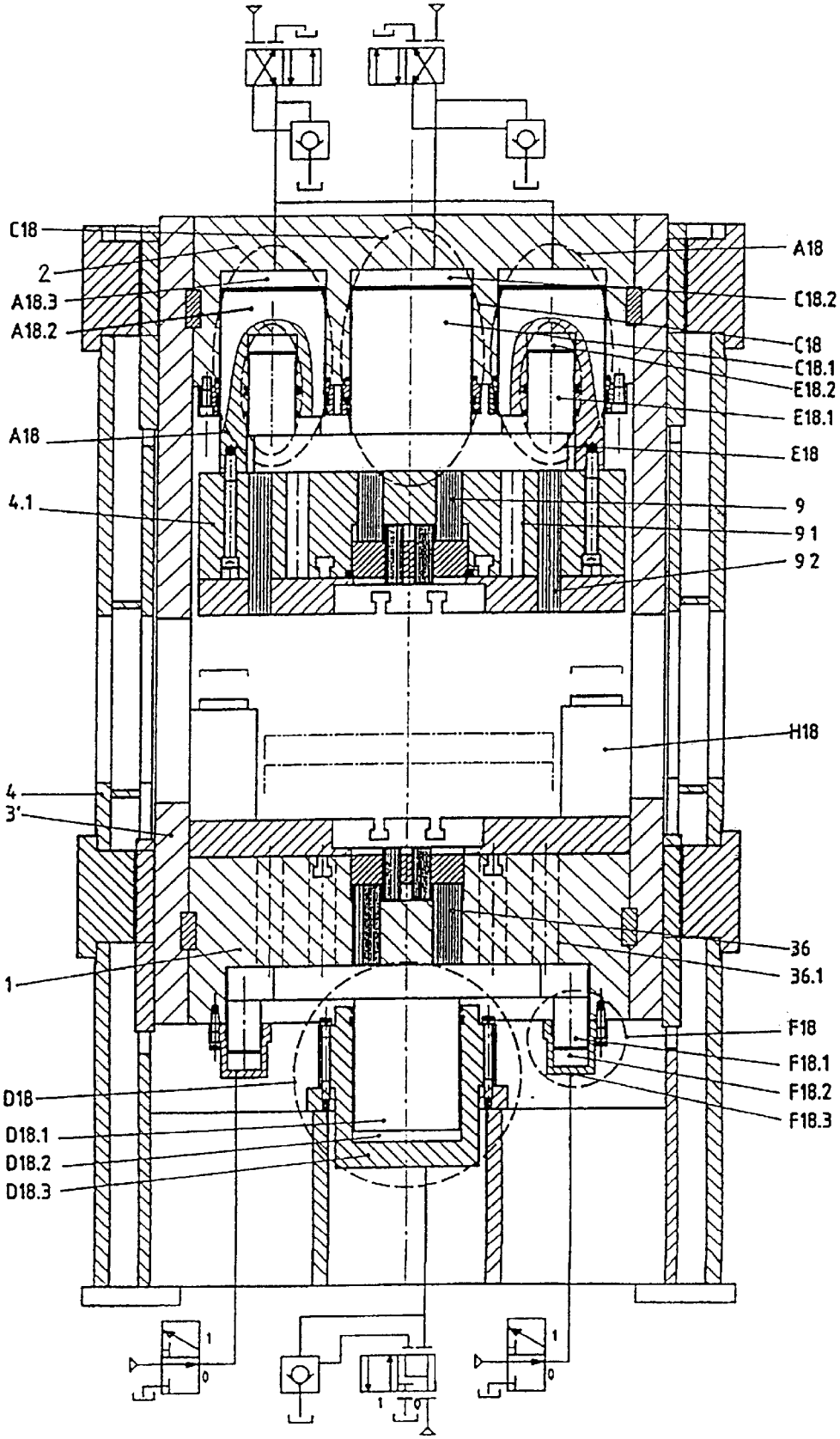
Figure 19:
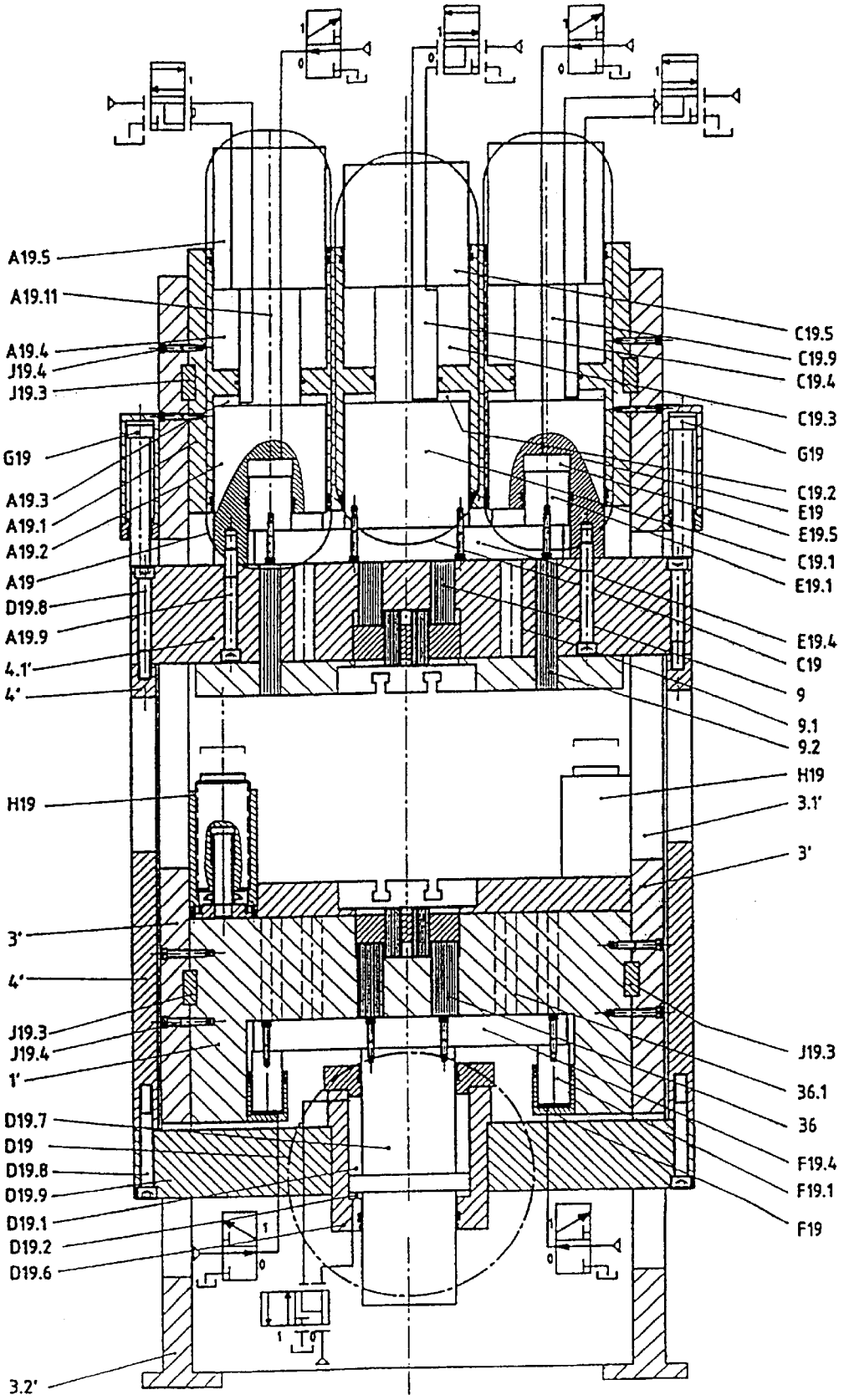

FIG. 14 shows an embodiment according to FIG. 3, but with a center support of the knife-edged ring part and counterstay part, and with installation space adjustment having a fixed stop, the working and knife-edged ring cylinders being arranged in the crossmember, the pressure medium actuated supporting cylinder being integrated between the working piston and the knife-edged ring cylinder piston, the infeed stroke and return stroke being executed by means of the counterstay cylinder, the piston rod diameters being coordinated in such a way that the infeed stroke, the counterstay pressing force and the return stroke are executed by differential switching, and the upper crosshead being fastened to the stand by means of connecting elements;

FIG. 15 shows an embodiment according to FIG. 14, the crossmember of the slide in each case being connected to a plate on both sides and forming an upwardly lengthened slide, guide elements being additionally mounted on the slide and stand, and the upper crosshead being fastened to the stand by means of connecting elements;

FIG. 16 shows an embodiment according to FIGS. 10 and 13, the double-acting working cylinders being arranged in the upper crosshead around the columns, the knife-edged ring cylinders being arranged in the crossmember around the columns, the bores for the knife-edged ring thrust bolts not being arranged around the center support, but being distributed in the upper crosshead, and the upper crosshead being fastened to the stand by means of connecting elements;

FIG. 17 shows a sectional illustration of a precision blanking press with hydraulically prestressed double-acting working cylinders, knife-edged ring cylinder and counterstay cylinder, two working cylinders, a knife-edged ring cylinder and two stripping cylinders being arranged in the upper crossmember, and the crossmember and the slide plate in each case being connected laterally to a plate and together forming an upwardly lengthened slide;

FIG. 18 shows an embodiment according to FIG. 17, but with single-acting cylinders; and FIG. 19 shows an embodiment according to FIG. 17, but with the movable and fixed machine components being reversed.

EXEMPLARY EMBODIMENTS

The invention is explained in detail below with reference to the accompanying drawings.

FIG. 1

A solution, in which the columns 3 are connected fixedly to the slide 1, is shown. The columns 3 pass through the stand 4 in the region of the upper crosshead 4.1 and are connected fixedly to the crossmember 2 here. A double-acting knife-edged ring cylinder C is integrated in the crossmember 2. Below the slide 1, the columns 3 are provided with a shoulder which is designed as a piston 3.1 of the working cylinder A. The working cylinder A consists of the cylinder housing 5, which is integrated in the stand 4, and of the piston 3.1, and these form the pressure medium actuated cylinder space 5.1. A cylinder/piston unit B is arranged between the slide 1 and the upper crosshead 4.1 of the stand 4; the effective hydraulic area of the piston 7 is equal in size to the piston area 3.1. The counterstay cylinder D is integrated in the lower crosshead of the stand 4 below the slide 1.

The precision blanking press is illustrated, here, in the lower initial position. The slide 1 is moved upward by means of the rapid-stroke cylinder G. During the infeed stroke, the piston 7 displaces the pressure medium out of the cylinder space 6.1 of the cylinder 6, and the pressure medium is transferred into the cylinder space 5.1 of the cylinder A via the line 27.1, valve 26 and line 27.

During the infeed stroke of the slide 1, the crossmember 2 and cylinder housing 8, integrated therein, of the knife-edged ring cylinder C are moved upward synchronously. The piston 13 of the knife-edged ring cylinder C remains constantly in contact with the thrust bolt 9 and is held in this lower position by means of the piston 21 of the pressure medium loaded cylinder E. The piston 21 is connected to the stand 4 by means of connecting elements 23. As a result of the upward movement of the cylinder housing 8, the pressure medium has to be transferred out of the cylinder space 15 into the cylinder space 12 via the line 14.1, valve 16 and line 14.

The piston 35 of the counterstay cylinder D, the housing 30 of which is fastened to the stand 4, is connected to the slide 1 by means of the piston 44 of the pressure medium loaded cylinder F; the piston 35 remains constantly in contact with the thrust bolts 36 and moves upward with the infeed movement of the slide 1. The piston 44 is connected fixedly to the slide 1 via connecting elements 46. As a result of the upward movement of the piston 33, the pressure medium is transferred out of the cylinder space 39 into the cylinder space 34 via the line 37, valve 38 and line 37.1.

During the changeover from the infeed stroke to the working stroke, the valves 26, 16, 38, 22 and 43 are changed over from switching position "0" to switching position "1". In this case, the working force of the cylinder A, which remains connected to the pressure medium source 40, becomes effective immediately, since the cylinder space 6.1 of the cylinder B is connected to the tank via the valve 26.

After the changeover of the valve 16, the pressing force of the knife-edged ring cylinder C also becomes effective immediately, since the cylinder space 12 remains connected to the pressure medium source 18 and the cylinder space 15 is connected to the tank 17 by the valve 16. The pressing force is transmitted into a precision blanking die via the thrust bolts 9 for the purpose of imprinting the knife-edged ring contour. A knife-edged ring cylinder supporting force is led from the housing 8 into the crossmember 2 and from here via the columns 3 into the slide 1. During the working stroke, no relative movement takes place between the knife-edged ring cylinder C with piston 13 and the slide 1. The working force of the main drive is not reduced by the knife-edged ring pressing force.

The piston 21 of the cylinder E is pressure-relieved via the valve 22 in switching position "1" at the start of the working stroke, and the piston 13 can be displaced upward.

After the changeover of the valve 38, the pressing force of the counterstay cylinder D also becomes effective immediately, since the cylinder space 34 remains connected to the pressure medium source 40 and the cylinder space 39 is connected to the tank 41 via the valve 38. The pressing force is transmitted to the precision blanking die via the thrust bolt 36 for the purpose of pressing the workpiece. The counterstay cylinder supporting force is transmitted to the stand 4 from the housing 30. During the working stroke, no relative movement takes place between the counterstay cylinder D and the workpiece in the die.

The piston 44 of the cylinder F is pressure-relieved via the valve 43 in switching position "1" at the start of the working stroke; the piston 35 moves downward in relation to the working stroke of the slide 1. The working force of the main drive, i.e., the working cylinder A is not reduced by the counterstay pressing force.

At the end of the working stroke, the valves 26, 16, 38, 22 and 43 are changed over from switching position "1" to switching position "0".

The cylinder space 6.1 of the cylinder B is connected to the pressure medium source 40 via the valve 26 and generates a counterforce to the pressure medium actuated cylinder A, the working force being cancelled.

The cylinder space 15 of the knife-edged ring cylinder C is connected to the pressure medium source 18 via the valve 16 and generates a counterforce to the cylinder space 12, the knife-edged ring force being cancelled. The supporting cylinder E is pressure-loaded as a result of the changeover of the valve 22 and pushes the piston 13 into its lower initial position; in this case, the blanking screen is pushed out via the thrust bolts 9.

The cylinder space 39 of the counterstay cylinder D is connected to the pressure medium source 40 via the valve 38 and generates a counter force to the cylinder space 34; The counterstay force is cancelled. The supporting cylinder F is pressure-loaded as a result of the changeover of a valve 43 and pushes the piston 35 into its upper initial position, in this case the precision blanking part being pushed out via the thrust bolts 36. The slide 1 is moved downward into the basic position of the machine by means of the rapid-stroke cylinder G, and the precision blanking cycle is terminated.

FIG. 2

The precision blanking press with single-acting cylinder systems is illustrated here. The arrangement of the knife-edged ring cylinder C2 in the crossmember 2 and of the counterstay cylinder D2 between the slide 1 and stand 4 corresponds to FIG. 1. The precision blanking press is illustrated in the initial position. At the start of the precision blanking cycle, the slide 1 is moved upward by means of the rapid-stroke cylinder G. During the infeed stroke, pressure medium is sucked into the main, knife-edged ring and counterstay cylinders via the follow-up suction valves 2.28, 2.15 and 2.39. At the start of the working stroke, the valves 2.16, 2.26 and 2.38 are changed over from switching position "0" to "1". The cylinder spaces 2.5.1, 2.12 and 2.33 are pressure-loaded. The working cylinder A2 generates the blanking force and moves the slide upward. At the same time, the piston 2.13 of the knife-edged ring cylinder C2 presses the knife-edged ring contour into the blanking screen via the thrust bolts 9. The knife-edged ring cylinder supporting force is led from the housing 2.8 into the crossmember 2 and from here via the columns 3 into the slide 1. During the working stroke, no relative movement takes place between the knife-edged ring cylinder C with piston 2.13 and the slide 1. The working force of the main drive is not reduced by the knife-edged ring pressing force.

The cylinder space 2.33 of the counterstay cylinder D2 is pressure-loaded at the start of the working stroke. The cylinder housing 2.30, which is connected to the thrust bolt 36 and the slide 1 via the supporting cylinder F, transmits the pressing force to the workpiece via the thrust bolts 36. The counterstay supporting force is transmitted to the stand 4 via the piston 2.31. During the working stroke, no relative movement takes place between the counterstay cylinder D2 and the workpiece. The working force of the main cylinder is not reduced by the counterstay supporting force.

At the end of the working stroke, the valves 2.16, 2.22, 2.39 and 2.43 are changed over from switching position "1" to "0" and the valve 2.26 is changed over from switching position "1" to "2". The cylinders A2, C2 and D2 become pressureless, and the supporting cylinders E and F are pressure-loaded. The supporting cylinder E pushes out the blanking screen and the supporting cylinder F the workpiece, as described with reference to FIG. 1.

FIG. 3

Figure 1:
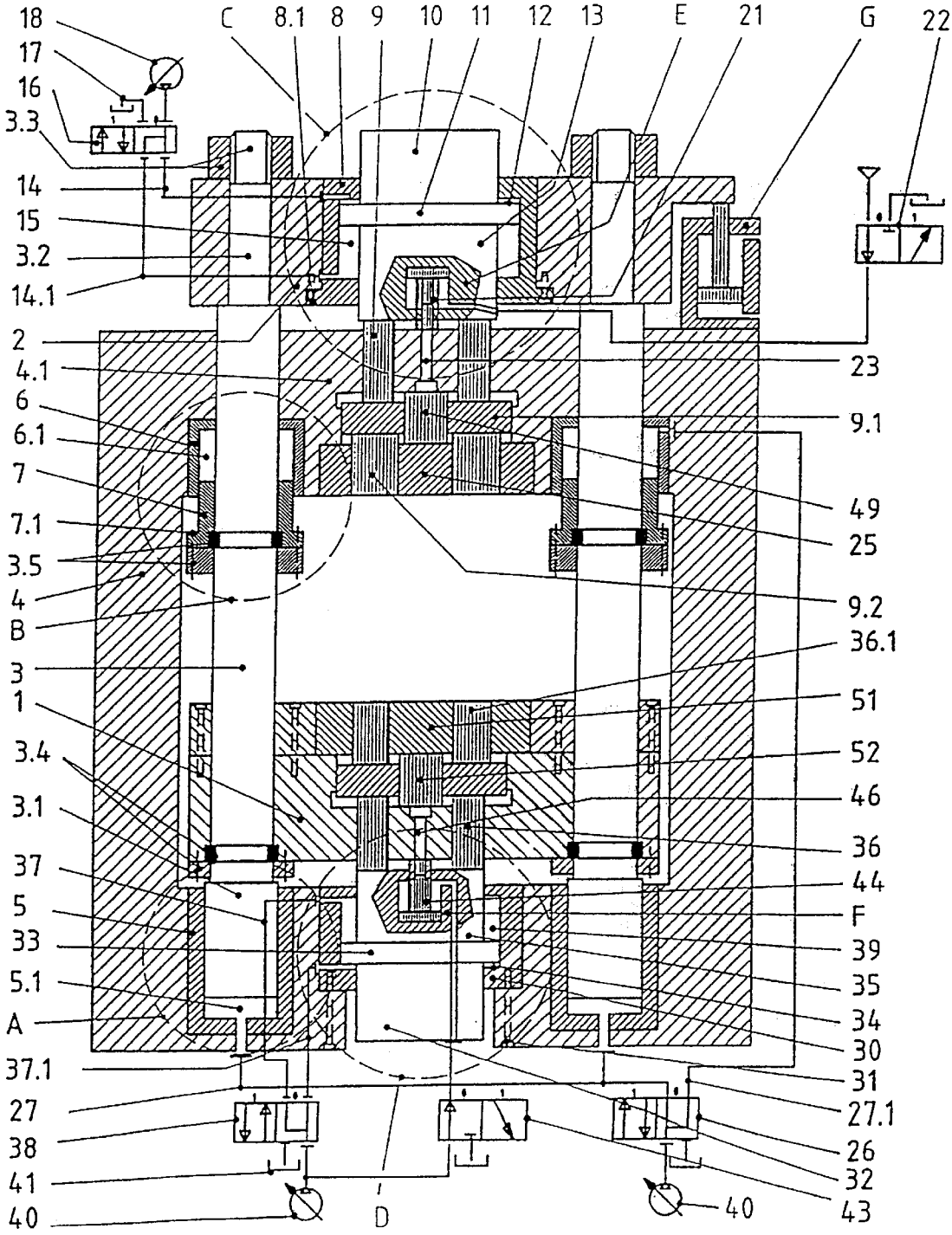
FIG. 1 shows a sectional illustration of the precision blanking press, with prestressed double-acting knife-edged ring cylinder, counterstay cylinder and working cylinder, having the necessary control devices, the knife-edged ring cylinder being coupled fixedly to the slide via columns, and center supports being provided on the knife-edged ring and counterstay in this exemplary embodiment.
Figure 2:
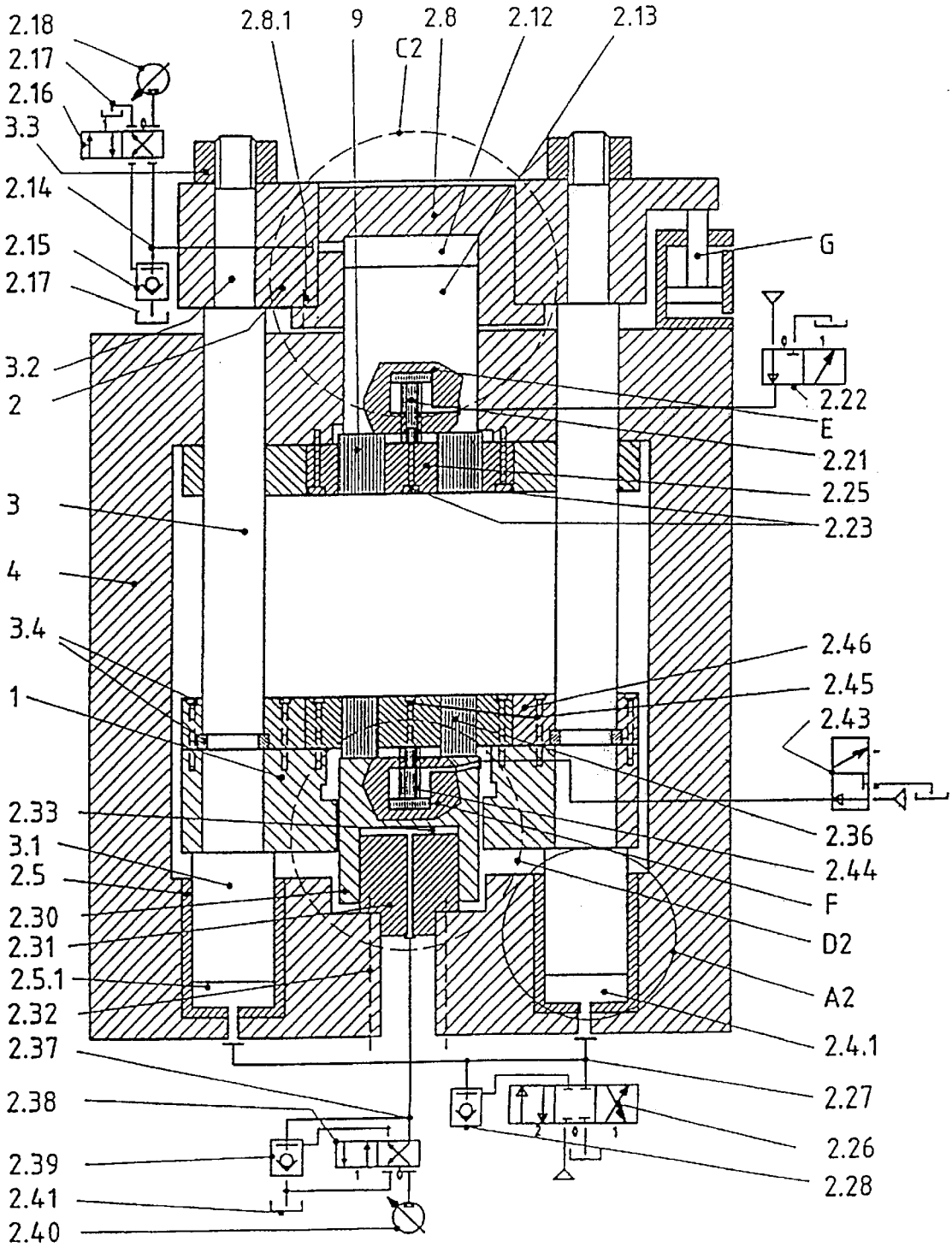
FIG. 2 shows an embodiment according to FIG. 1, but with single-acting cylinder systems, the knife-edged rings and counterstays being designed without a center support.

A precision blanking press of a design similar to that described in FIGS. 1 and 2 is illustrated. The working cylinder A3 is arranged in the upper crosshead of the stand 4. The area of the piston 3.5.2 is approximately equal to the areas of the four pistons 7. In the initial position and during the infeed and return stroke movements, the cylinder spaces 6.1 and 3.5.1 are pressure-loaded. The force of the cylinder A3 is equal to the forces of the four cylinders B3.

The knife-edged ring cylinder C3 is integrated in the piston 3.5.2 of the working cylinder A3. The effective areas 3.12 and 3.15 correspond to the areas 12 and 15 according to FIG. 1. The flow of the work cycle may be gathered from the description relating to FIG. 1. The precision blanking press is provided with an installation space adjustment 3.6 which is arranged below the slide 1. The columns 3 are provided at the lower end with a thread 3.6.1. The threaded nut 3.7 is fastened rotatably to the slide 1 by means of fastening elements 3.7.1. The threaded nuts 3.7 are provided with toothings for a chain drive or toothed belt drive. The four nuts 3.7 are adjusted synchronously via a chain or a toothed belt. The adjustment may be carried out in such a way that the stop face 7.1 of the piston 7 strikes the cylinder housing 6 at the end of the working stroke in the case of precision blanking dies which are of different heights.

FIG. 4

The example here shows a precision blanking press with single-acting cylinder systems. The mode of action and the operating mode are similar to those described in FIG. 2, and the cylinder arrangement is similar to that illustrated in FIG. 3.

FIG. 5

A precision blanking press, the mode of action of which was described with reference to FIGS. 1 and 3, is illustrated. The four prestressing cylinders B and B3 (FIGS. 1 and 3) are replaced by a cylinder B5. The cylinder B5 is arranged between the stand 4 and a second cross member 5.2. Installation space adjustment 3.6, as described in FIG. 3, is arranged below the crossmember 5.2.

FIG. 6

This version of the precision blanking press differs from the version according to FIG. 1 in that the four working cylinders A are replaced by a cylinder A6 with installation space adjustment. The counterstay cylinder D6 is integrated in the piston 6.6 of the working cylinder A6. The mode of action is described in FIG. 2 as regards the main drive and in FIG. 1 as regards the knife-edged ring cylinder and counterstay cylinder.

FIG. 7

Figure 6:
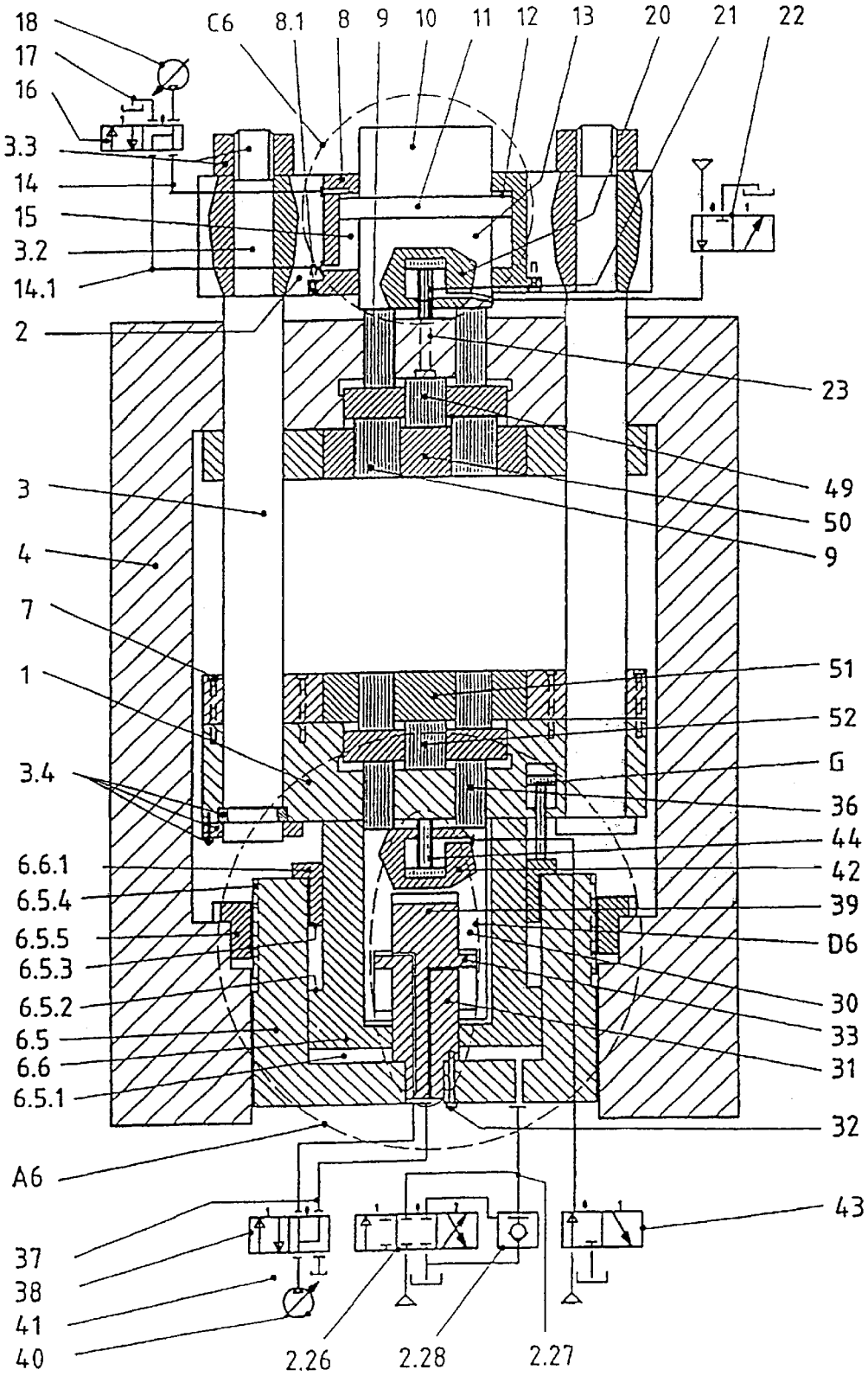
FIG. 6 shows a precision blanking press with a working cylinder arranged in the lower crosshead of the stand and with a knife-edged ring cylinder coupled via columns, the counterstay cylinder being integrated in the piston of the working cylinder, and installation space adjustment with a fixed stop being additionally provided.

The precision blanking press illustrated here is identical in design to the version according to FIG. 6, except that the knife-edged ring cylinder C6 is replaced by four cylinders C7 which are arranged in the upper region of the columns 3. The mode of action of the knife-edged ring cylinders is described in FIG. 1.

FIG. 8

The knife-edged ring cylinders C8 have now been integrated in the slide 1 on the lower end of the columns 3. See FIG. 1 for the mode of action.

FIG. 9

Figure 7:
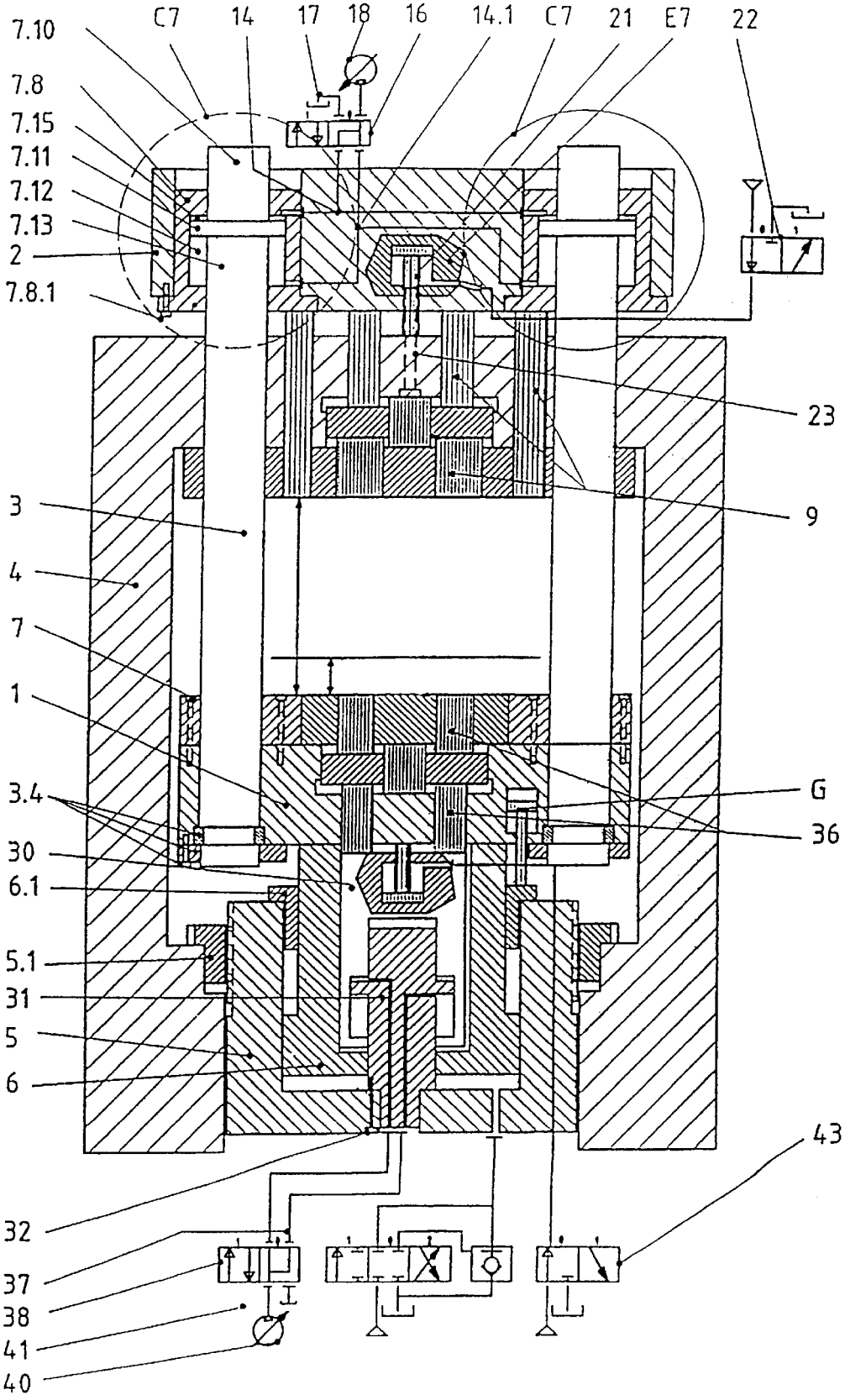
FIG. 7 shows an embodiment according to FIG. 6, the knife-edged ring cylinders being integrated on the columns in the crossmember.
Figure 8:
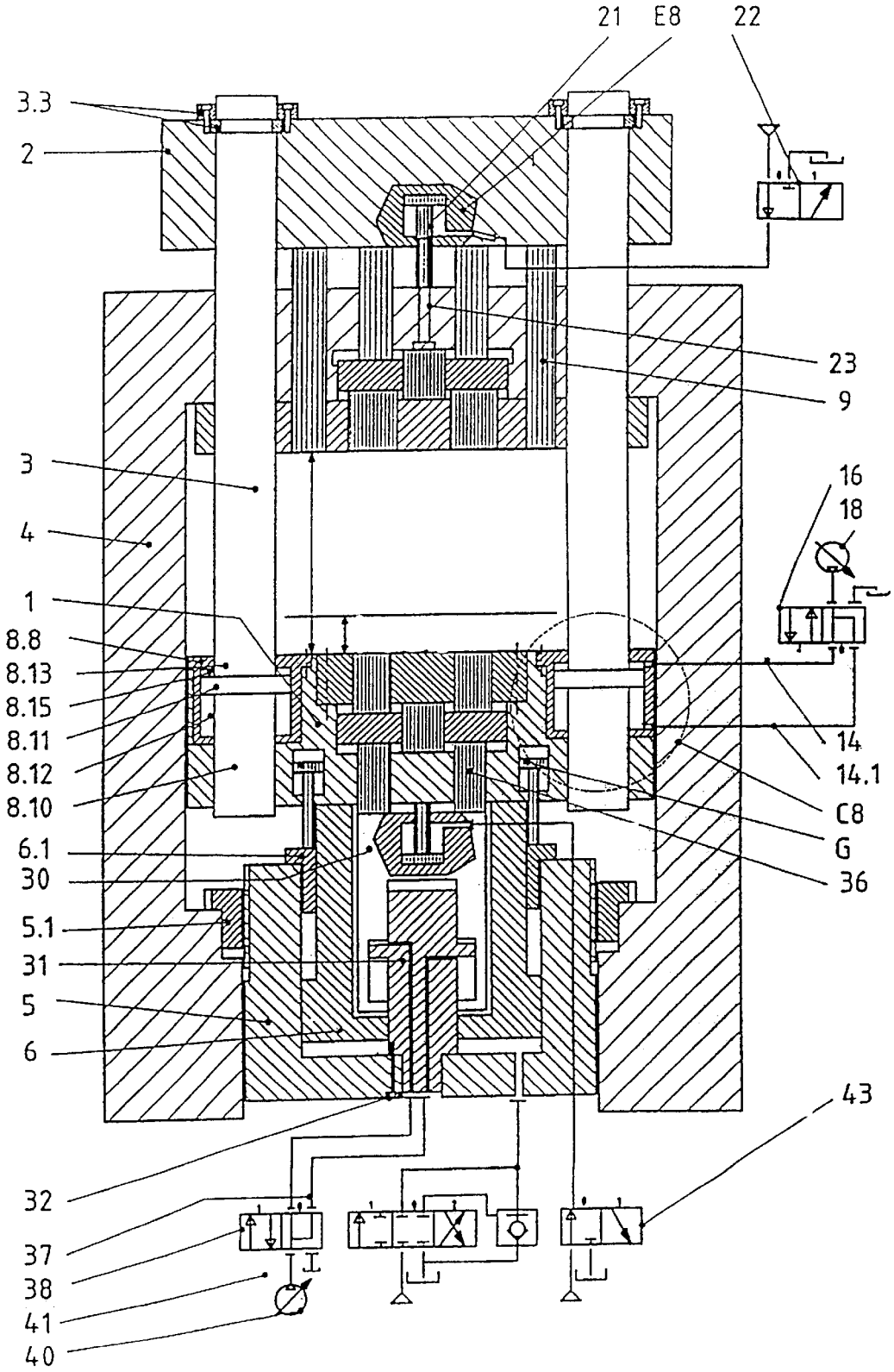
FIG. 8 shows an embodiment according to FIG. 7, the knife-edged ring cylinders being integrated on the columns in the slide.
Figure 9:
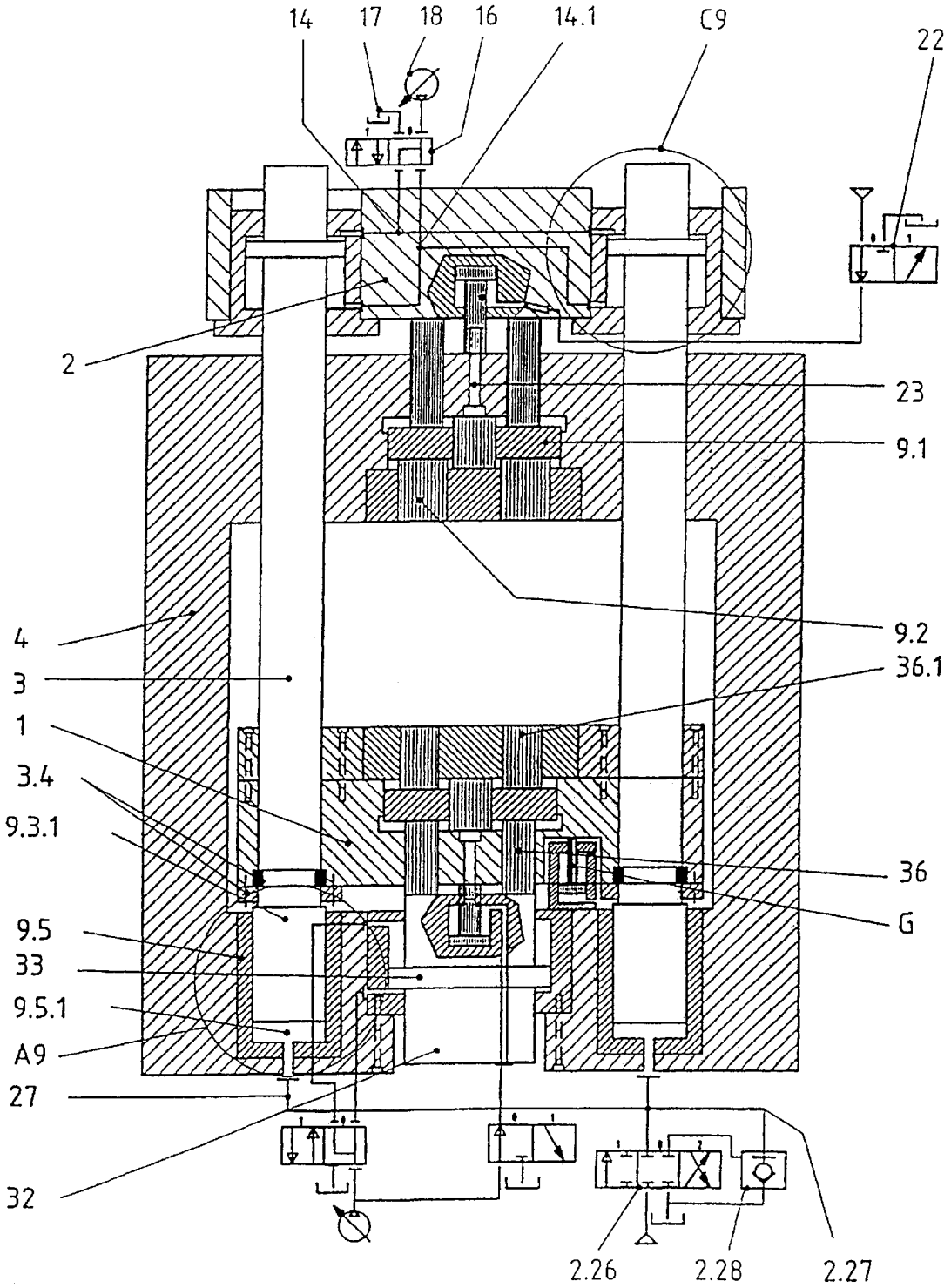
FIG. 9 shows an embodiment according to FIGS. 1 and 7, the knife-edged ring cylinders being integrated on the columns in the crossmember and the working cylinders being integrated on the columns in the stand.

The working and knife-edged ring cylinders are now arranged on the columns 3 of the precision blanking press; installation space adjustment, as illustrated in FIG. 3, may alternately be incorporated. The knife-edged ring cylinders C9 are designed, as illustrated in FIG. 7, and the working cylinders A9 correspond to the version according to FIGS. 1 and 2. See FIG. 1 again for the mode of action.

FIG. 10

In this version, a double-acting working cylinder A10 is arranged in the lower crosshead of the stand 4. The operating mode corresponds to statements made with regard to FIG. 1.

FIG. 11

Figure 4:
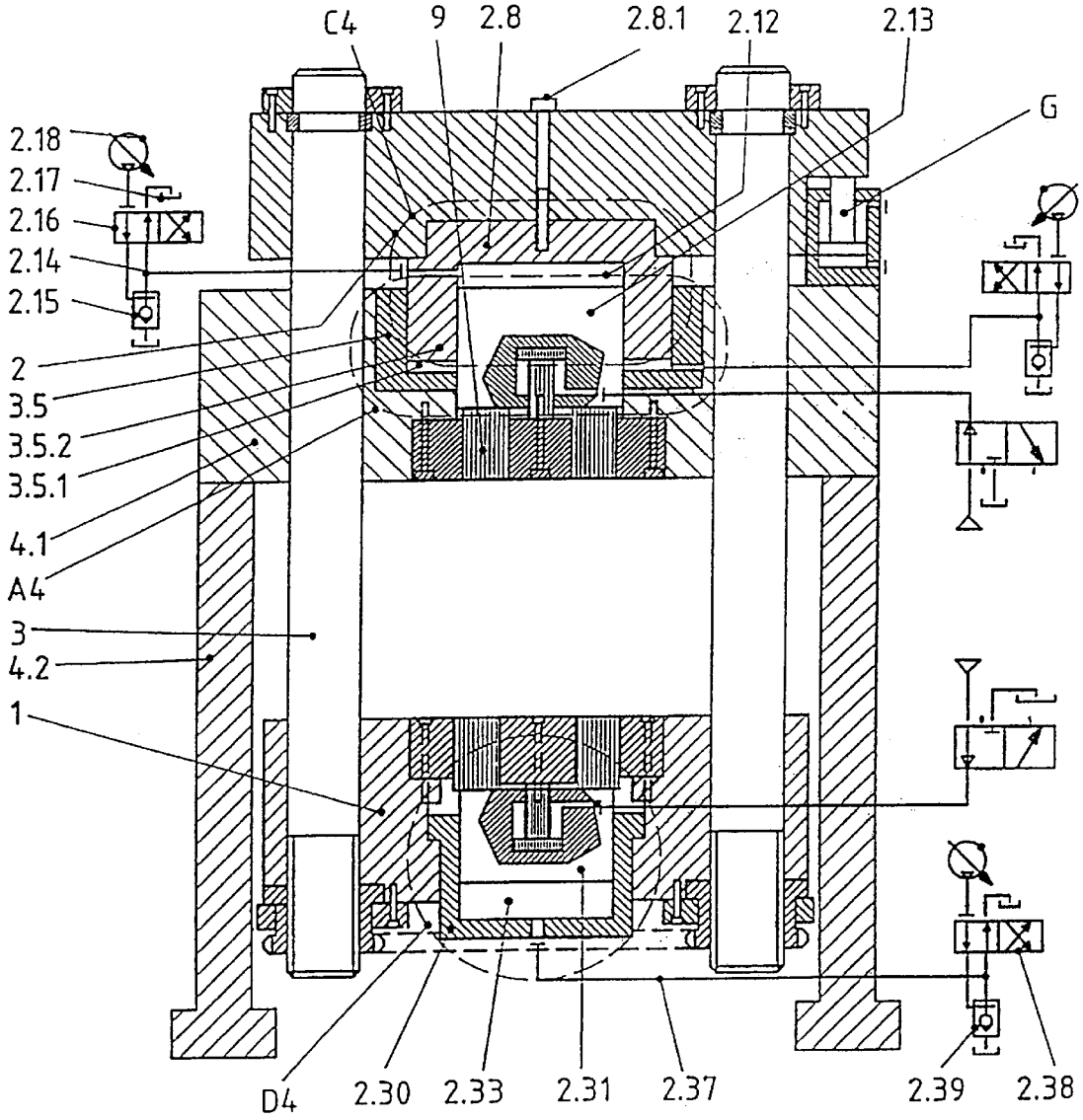
FIG. 4 shows an embodiment according to FIG. 3, but with a single-acting cylinder.
Figure 5:
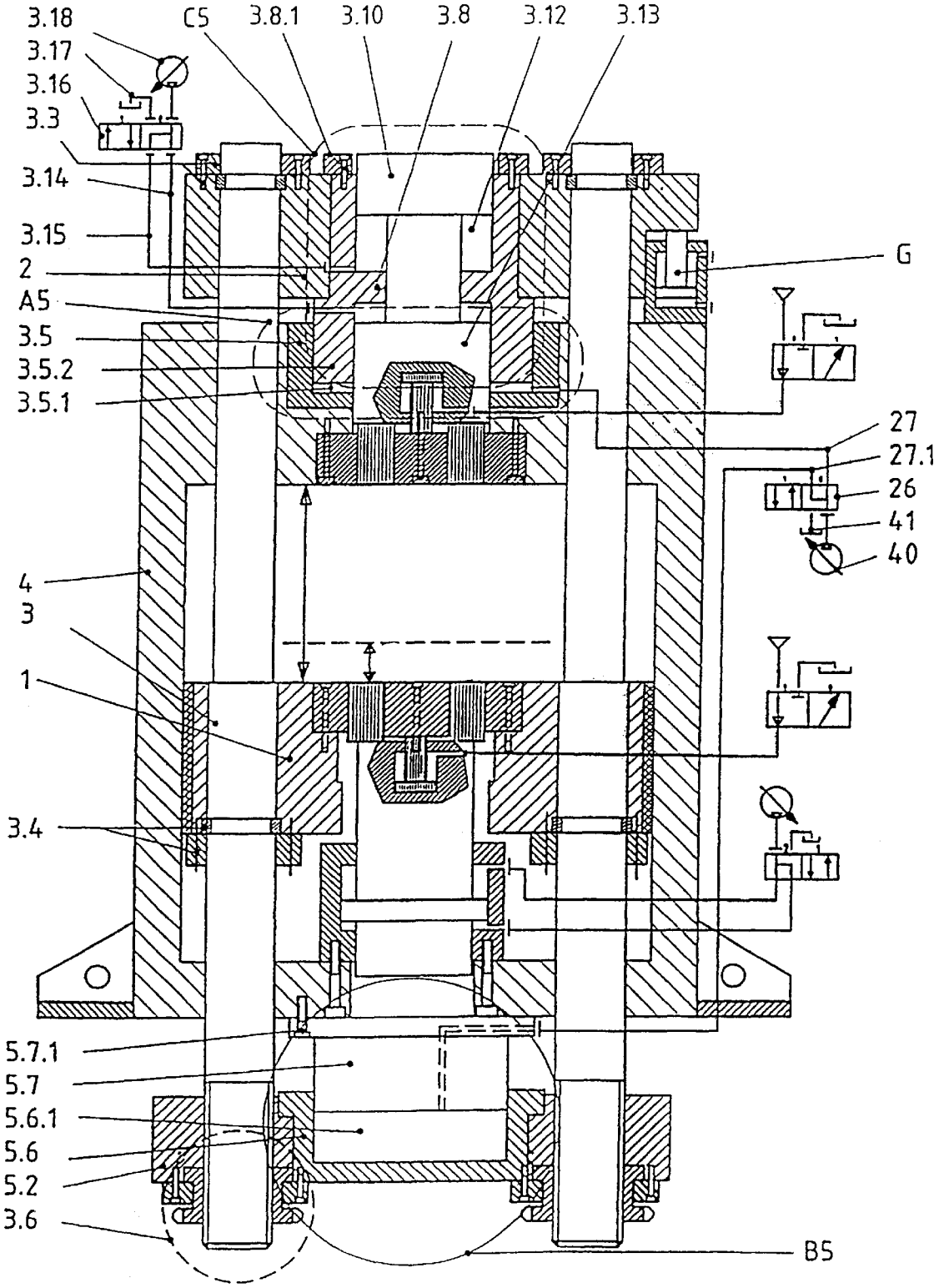
FIG. 5 shows an embodiment according to FIG. 3, as a prestressed precision blanking press with double-acting working cylinder, knife-edged ring cylinder and counterstay cylinder.

A precision blanking press with a mechanical main drive is shown. The main drive may be designed as an eccentric drive, as illustrated, or as a toggle drive, not illustrated. The infeed, working and return strokes of the slide 1 are executed by means of the mechanical drive 11.3.1, 11.3.2, 11.3.4. The knife-edged ring cylinder C11 and the counterstay cylinder D11 correspond in their mode of action to the description according to FIG. 1. Installation space adjustment, as illustrated in FIG. 4, makes it possible for dies of different heights to be used. The working force of the mechanical main drive is not reduced by the knife-edged ring and counterstay pressing force.

FIG. 12

A single-acting working cylinder A12 is arranged in the upper crosshead of the stand 4, the operating mode being described with reference to FIG. 2. By the arrangement of the working cylinder A12 in the upper crosshead, the working force is led directly from the piston 12.4 via the columns 3 into the slide 1. The stand 4 is not subjected to the load of the working force and only has to absorb the supporting forces of the counterstay. A guide 12.1 may additionally be mounted on the slide 1.

FIG. 13

Figure 12:
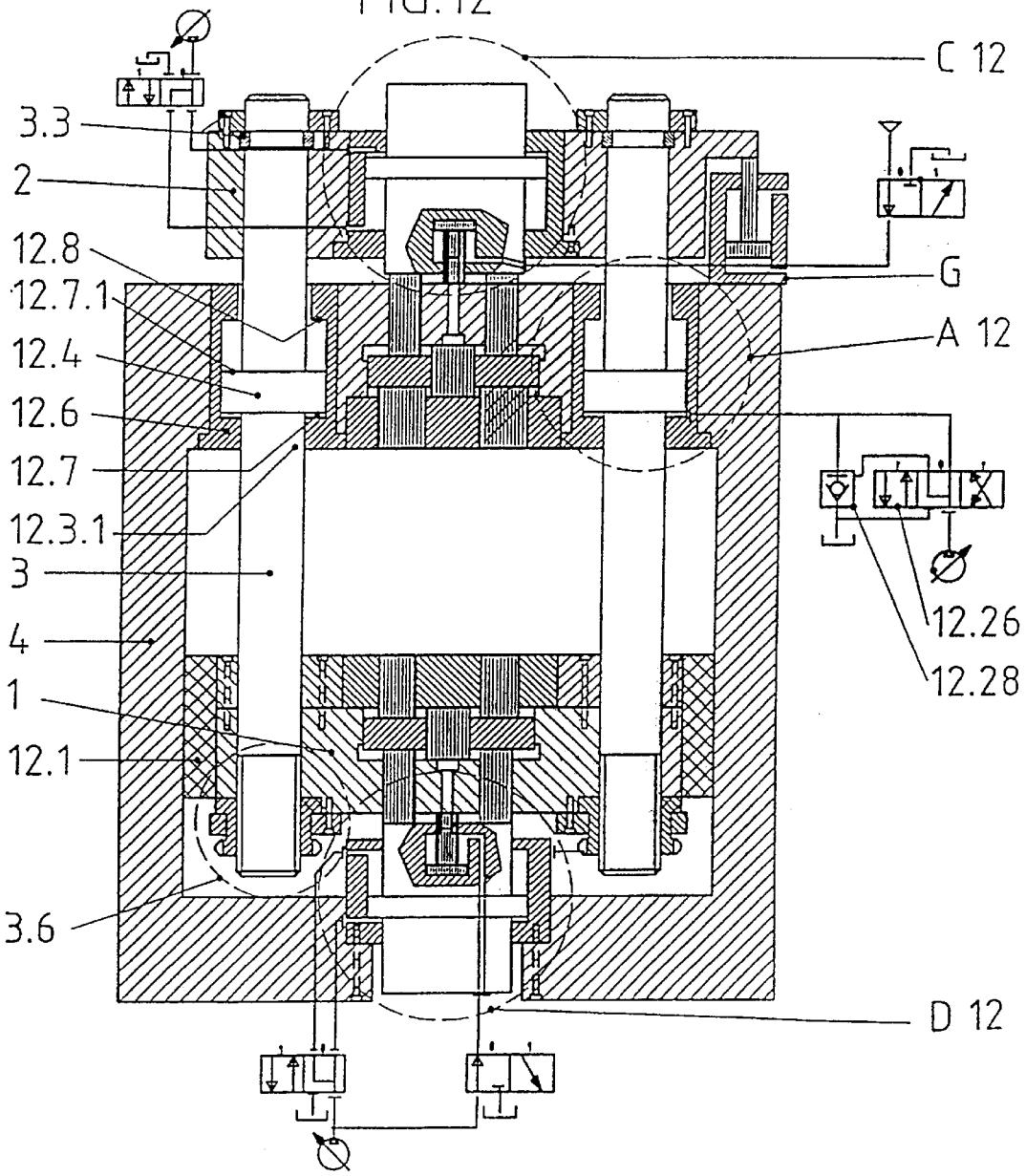
FIG. 12 shows an embodiment according to FIGS. 1, 2 and 3, the single-acting working cylinders being arranged in the upper crosshead of the stand, and insulation space adjustment being arranged below the slide in this version.

The precision blanking press shown is identical in design to the version according to FIG. 12, except that the working cylinder is double-acting. See FIG. 1 for the mode of action.

FIG. 14

In the compact embodiment, a working cylinder A14, a knife-edged ring cylinder C14, a supporting cylinder E14 and an installation space adjustment with a fixed stop are integrated in a cylinder/piston unit. As in FIGS. 12 and 13, the stand 4 is not subjected to the load of the working force. The infeed and return strokes of the slide are additionally executed by means of the counterstay cylinder via the valve 14.38. The piston rod diameters have been coordinated in such a way that the infeed stroke, counterstay pressing force and return stroke are executed by differential switching. When the valve 14.38 is in position "0", all the connections are broken, and the slide is in the BDC position. In position "1", the cylinder spaces 14.39 together with 14.34 are connected to the pressure medium source. The differential surface 14.40 pushes the piston, including the slide 1 and crossmember 2, upward. At the start of the working stroke, the valve 14.38 is changed over to position "2", the cylinder space 14.39 is pressure-relieved, and the cylinder space 14.34 remains connected to the pressure medium source and thus generates the counterstay pressing force. The return stroke is initiated by means of the position "3", the cylinder space 14.34 being connected to the tank and the cylinder space 14.39 to the pressure medium source. At BDC, there is a changeover to position "0".

FIG. 15

According to the design variant shown in FIG. 15, the crossmember 2 and the slide 1 are in each case connected to a plate 15.1 on both sides; they form an upwardly lengthened slide. In addition, guide elements 15.6 and 15.8 are mounted on the slide 1 and stand 4. The upper crosshead 4.1 is fastened to the stand 4 by means of connecting elements, and the columns 3 from FIG. 14 are replaced by the plates 15.1. The stand 4 is not subjected to the force of the working cylinder A.

FIG. 16

In this embodiment according to FIGS. 10 and 13, the double-acting working cylinders A16 are arranged in the upper crosshead 4.1 around the columns 3 and the knife-edged ring cylinders C16 are arranged in the crossmember 2 likewise around the columns 3. The conventional center support is dispensed with. The bores 16.10 for the knife-edged ring thrust bolts 9 are not arranged around the center, but are distributed in the upper crosshead 4.1. The stand 4 is not subjected to the force of the working cylinder A16.

FIG. 17

An embodiment, in which the crossmember 2 is designed as a cylinder housing, is shown. Two working cylinders A17, a knife-edged ring cylinder C17 and two stripping cylinders E17 are integrated in the crossmember 2. The two double-acting working cylinders A17 are arranged laterally in the crossmember 2. The lower piston A17.2, together with a cylinder housing 2 (designed here as a crossmember), forms the lower cylinder space A17.3. The upper cylinder space A17.4 is formed by the cylinder housing 2 and the upper piston rod A17.5. The two lower piston rods A17.2 are connected fixedly to the upper crosshead 4.1 via connecting elements A17.9. The two upper piston rods A17.5 are connected to a plate which is designed as a hydraulic distributor block A17.10. The double-acting knife-edged ring cylinder C17 is arranged centrally between the working cylinders A17. The lower piston C17.1, together with the cylinder housing 2, forms the lower cylinder space C17.2. The upper cylinder space C17.4 is formed by the cylinder housing 2 and the upper piston rod C17.5. A plate E17.4, on which the thrust bolts 9 are supported, is fastened to the knife-edged ring cylinder piston C17.1. The stripping cylinders E17 are integrated into the piston A17.2. The two laterally arranged supporting cylinders E17 can compensate hydraulically eccentric loads caused by the knife-edged ring forces.

The slide plate 1, together with the plates 3' and the crossmember 2, forms the press slide. The counterstay cylinder D17 is arranged in the lower crosshead of the stand 4 below the slide plate 1. The two laterally arranged supporting cylinders F17 can compensate hydraulically eccentric loads caused by the counterstay forces. The ejection cylinders F17 are fastened to the slide plate 1. The stand 4 is not subjected to the working force of the working cylinders A17.

FIG. 18

In contrast to the precision blanking press according to FIG. 17, here the working, knife-edged ring and counterstay cylinders are single-acting. See FIGS. 2 and 17 for the mode of action of the press.

FIG. 19

A precision blanking press, as described in FIG. 17, is illustrated, the movable and fixed machine components having been reversed. The slide plate 1' is connected fixedly to the machine stand, and the function of the press slide is performed by the movable slide 4.1'. The slide plate 1', crossmember A19.1 and plates 3' are connected fixedly to one another and together form the stand of the precision blanking press. Plates 3' are lengthened downward via the slide plates 1' and, in the region 3.2', form the foot of the stand. The housings of the two working cylinders A19 and the housing of the knife-edged ring cylinder C19 are connected fixedly to the stand by means of the crossmember A19.1. The two lower piston rods A19.2 of the working cylinders A19 are fastened to the movable slide 4.1' by means of connecting elements A19.9. The piston rod C19.1 of the knife-edged ring cylinder C19 is connected to the slide 4.1' via the plate E19.4 as a result of the hydraulic coupling of the supporting cylinders E19. The cylinder housing D19.6 of the counterstay cylinder D19 is connected fixedly to the movably arranged crossmember D19.9 below the slide plate 1'. The slide 4.1' and the crossmember D19.9 are connected to one another by means of the plates 4' and connecting elements D19.8. Columns could also be used instead of the plates 3', 4'.

The infeed cylinders G19 are fastened with their cylinder housings to the plates 3' and with the piston rods to the slides 4.1'. During the closing of the die, the slide 4.1' and the housing D19.6, connected fixedly to the latter, of the counterstay cylinder D19 are moved downward via the infeed cylinders G19. During this infeed movement, relative movement takes place between the piston rods and the cylinder housings of the working cylinders A19, of the knife-edged ring cylinder C19 and of the counterstay cylinder D19. The pressure medium is transferred from the upper cylinder spaces into the lower cylinder spaces. The operating mode of the double-acting cylinders is described in FIG. 1.

What is claimed is:

1. A precision blanking press, which comprises: a hydraulically or mechanically driven slide; at least one knife-edged ring cylinder and at least one counterstay cylinder in a stand with at least one crosshead; wherein the slide is provided on one side of the crosshead and a crossmember is provided on the other side of the crosshead; and wherein said slide, crosshead and crossmember are connected to one another via connecting means; at least one thrust piece for transmitting a pressing force to a blanking die for imprinting a knife-edged ring contour on a workpiece, said thrust piece provided on the crosshead; and said knife-edged ring cylinder arranged adjacent said thrust piece;

wherein:

(a) a piston of at least one of the knife-edged ring cylinder and the crossmember is assigned a supporting cylinder with a piston which is fixed to at least one crosshead; and (b) a piston of the knife-edged ring cylinder and the pistons of the supporting cylinders are together connected to a plate and the supporting cylinders are integrated into the piston of a working cylinder.

2. A precision blanking press, which comprises: a hydraulically or mechanically driven slide; at least one knife-edged ring cylinder and at least one counterstay cylinder in a stand with at least one crosshead; wherein the slide is provided on one side of the crosshead and a crossmember is provided on the other side of the crosshead; and wherein said slide, crosshead and crossmember are connected to one another via connecting means; at least one thrust piece for transmitting a pressing force to a blanking die for imprinting a knife-edged ring contour on a workpiece, said thrust piece provided on the crosshead; and said knife-edged ring cylinder arranged adjacent said thrust piece;

wherein:

(a) the counterstay cylinder has a piston for cooperation with at least one of said thrust pieces, said piston being assigned at least one supporting cylinder having a piston which is fixed to the slide; and (b) the piston of the counterstay cylinder and the pistons of the supporting cylinders are together connected to a connecting element and the supporting cylinders are fastened to the slide.

* * * * *